US005188283A

United States Patent [19]

Gu

[11] Patent Number: 5,188,283

[45] Date of Patent: Feb. 23, 1993

[54] BEVERAGE CONTAINER WITH CONCEALED STRAW

[75] Inventor: Huan-Lung Gu, Hsinchu Hsien, Taiwan

[73] Assignee: Industrial Technology Research Institute, Hsinchu Hsien, Taiwan

[21] Appl. No.: 823,778

[22] Filed: Jan. 21, 1992

[51] Int. Cl.[5] ..... A47G 19/22

[52] U.S. Cl. ..... 229/103.1; 215/1 A; 220/707; 220/708

[58] Field of Search ..... 229/103.1; 215/1 A; 220/90.2, 707, 708, 710

[56] References Cited

U.S. PATENT DOCUMENTS

| | | | |
|---|---|---|---|
| 2,844,267 | 7/1958 | Petriccione | 215/1 A |
| 3,240,415 | 3/1966 | Pugh, Sr. | 229/103.1 |
| 3,332,567 | 7/1967 | Pugh, Sr. | 229/103.1 |
| 3,486,679 | 12/1969 | Pfahler | 229/103.1 |
| 3,792,798 | 2/1974 | Chang | 229/103.1 |
| 3,799,914 | 3/1974 | Schmit et al. | 229/103.1 |
| 3,874,554 | 4/1975 | Chang | 229/103.1 |
| 4,247,016 | 1/1981 | Shaw | 229/103.1 |
| 4,291,814 | 9/1981 | Conn | 215/1 A |
| 4,300,716 | 11/1981 | Jennings | 229/103.1 |
| 4,830,204 | 5/1989 | Lin | 215/1 A |
| 5,116,105 | 5/1992 | Hong | 220/710 |

FOREIGN PATENT DOCUMENTS

| | | | |
|---|---|---|---|
| 1514427 | 2/1968 | France | 229/103.1 |

*Primary Examiner*—Gary E. Elkins
*Attorney, Agent, or Firm*—W. Wayne Liauh

[57] ABSTRACT

A beverage container with concealed straw, particularly a container which can have a straw exposed by lifting of a sealing tape for suction of the beverage, comprising mainly a straw placed in the container, and a sealing tape above the straw for concealing the straw in the container so that by lifting of the sealing tape, the straw can be pulled up for suction and ingesting of liquid from the container.

1 Claim, 8 Drawing Sheets

BEVERAGE CONTAINER WITH CONCEALED STRAW

BACKGROUND OF THE INVENTION

The present invention relates to a beverage container, in particular a beverage container with concealed straw.

Numerous harmful substances are produced in many industrial processes, and such harmful substances can cause different diseases, some even cureless, to the human being. Therefore, environmental protection has been a common concern of mankind today, and objection to setting up of industrial production plants is heard frequently. Particularly, food hygiene is increasingly stressed today. Therefore, there are rules for marking and labeling on food packages, and there are health requirements for the packaging of foods. As for the packaging of beverages, aluminum tin cans, aluminum foil packages, paper packages and the like are used, but irrespective of the method of packaging, a straw is always required for the drinking of such beverage. However, straws are always exposed to the environment, and they are usually, more or less, contaminated.

Moreover, a straw is required for a packaged beverage, and such straw is kept outside of the packaging, or supplied separately. Use of such straw has the following disadvantages:

(1) The straw attached to the package could be damaged, deformed, omitted or overlooked in the course of handling and display;

(2) The straw could be contaminated by hand before it is used, in particular during transition from seller to buyer;

(3) It is inconvenient to remove the straw, and it is inconvenient to serve the beverage without the straw;

(4) The enclosure of the package, the straw and the package are separated and become pieces of refuse after serving; and (5) The beverage might be spilled from its package when the paper package or plastic bottle is opened, and ingestion of the beverage from an aluminum foil package is difficult because of lack of convection of air.

In view of the above defects, the inventor has created a new structure of beverage container with a concealed straw to eliminate the above defects.

SUMMARY OF THE INVENTION

The main object of the present invention is to provide a beverage container with concealed straw which meets sanitary hygiene requirements and is not contaminated by the environment.

Another object of the present invention is to provide a beverage container with concealed straw which can be used conveniently, eliminate the possibility of spilling during opening and ingestion, and provide an instant straw with use of the container.

BRIEF DESCRIPTION OF THE DRAWINGS

These and other objects and features of the invention will become more apparent from the following description in connection with the accompanying drawings wherein.

DETAILED DESCRIPTION OF THE PREFERRED EMBODIMENTS

Figure 1:
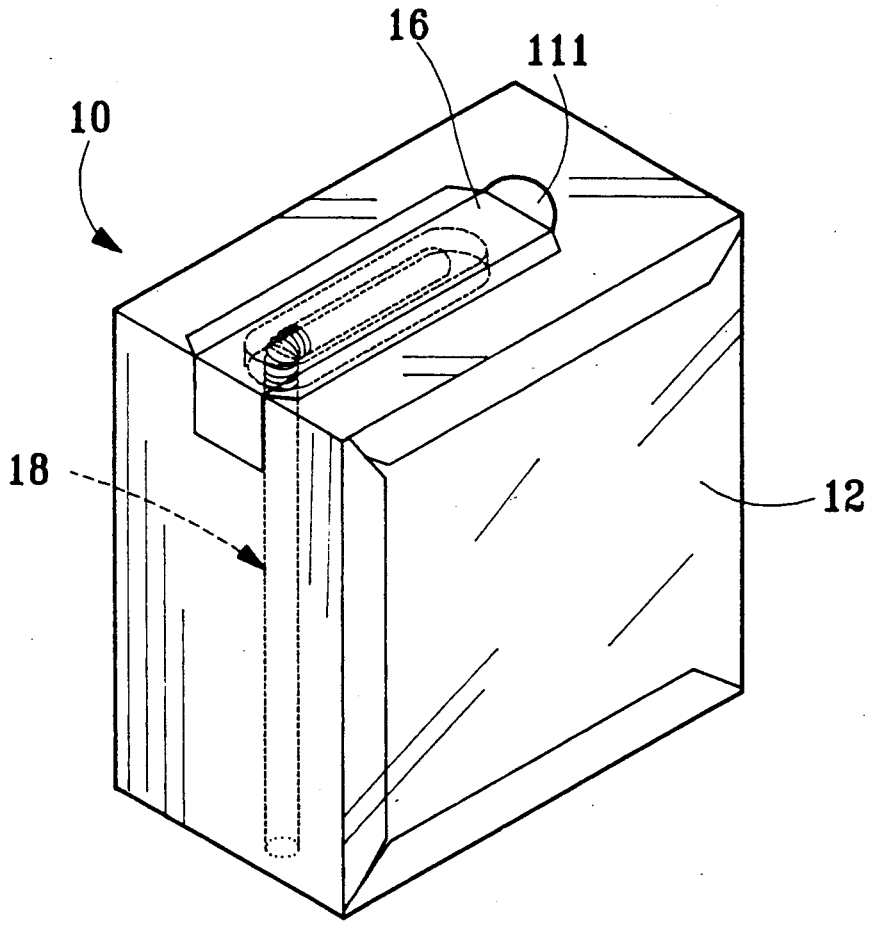
FIG. 1 is a perspective view of a beverage container with concealed straw according to the present invention.
Figure 1A:
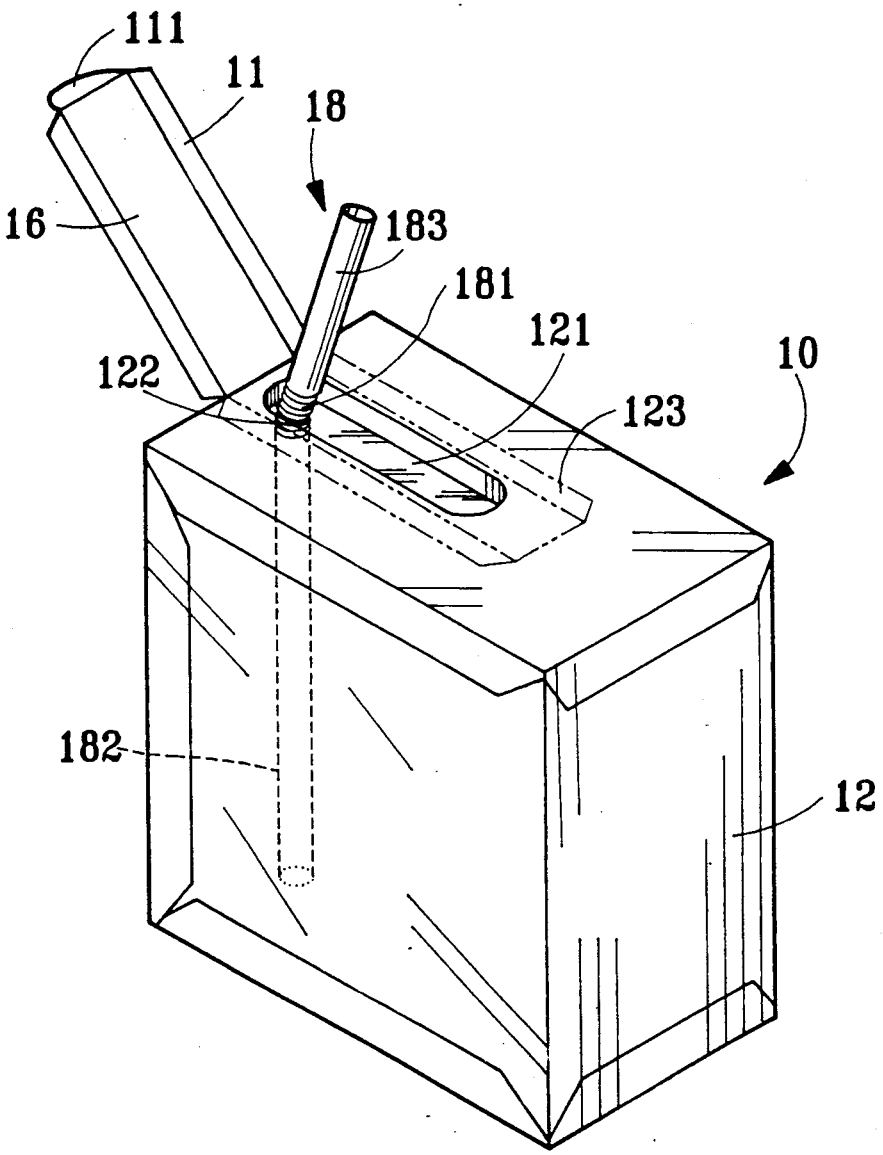
FIG. 1A illustrates the beverage container with concealed straw in using condition.

Please refer to FIGS. 1 and 1A, the beverage container with concealed straw (10) according to the present invention comprises mainly a container (12), a concealed straw (18) placed within the container (12), and a sealing tape (16) to seal the container (12). On the top of the container (12) there is a slot (121) of adequate length with a penetrating hole (122). The concealed straw (18) is designed with a pleated section (181) at an appropriate location for retaining the concealed straw (18) at the penetrating hole (122) by a design such that the diameter of the penetrating hole (122) is slightly smaller than the outer diameter of the pleated section (181) such that the concealed straw (18) can be retained and will not be separated from the container (12). The concealed straw (18) is positioned such that its lower portion (182), i.e., the portion below the pleated section (181), is within the container (12), its upper portion (183) is outside the container (12), the upper portion (183) can be bent and placed within the slot (121) and then the slot (121) is sealed by the sealing tape (16). The sealing tape (16) has a dimension slightly larger than the slot (121) so that the slot (121) can be sealed by the sealing tape (16).

The sealing tape (16) has a lifting tab (111). By lifting at the lifting tab (111) the sealing tape (16) can be removed, thus the upper portion of the concealed straw (18) can be pulled up to a certain degree for suction of the beverage from the container (12).

The concealed straw (18) and the beverage in the container (12) are sterilized at high temperature after filling and packing. Therefore, the cleanliness and sanitary condition of the concealed straw can be assured.

Figure 2:
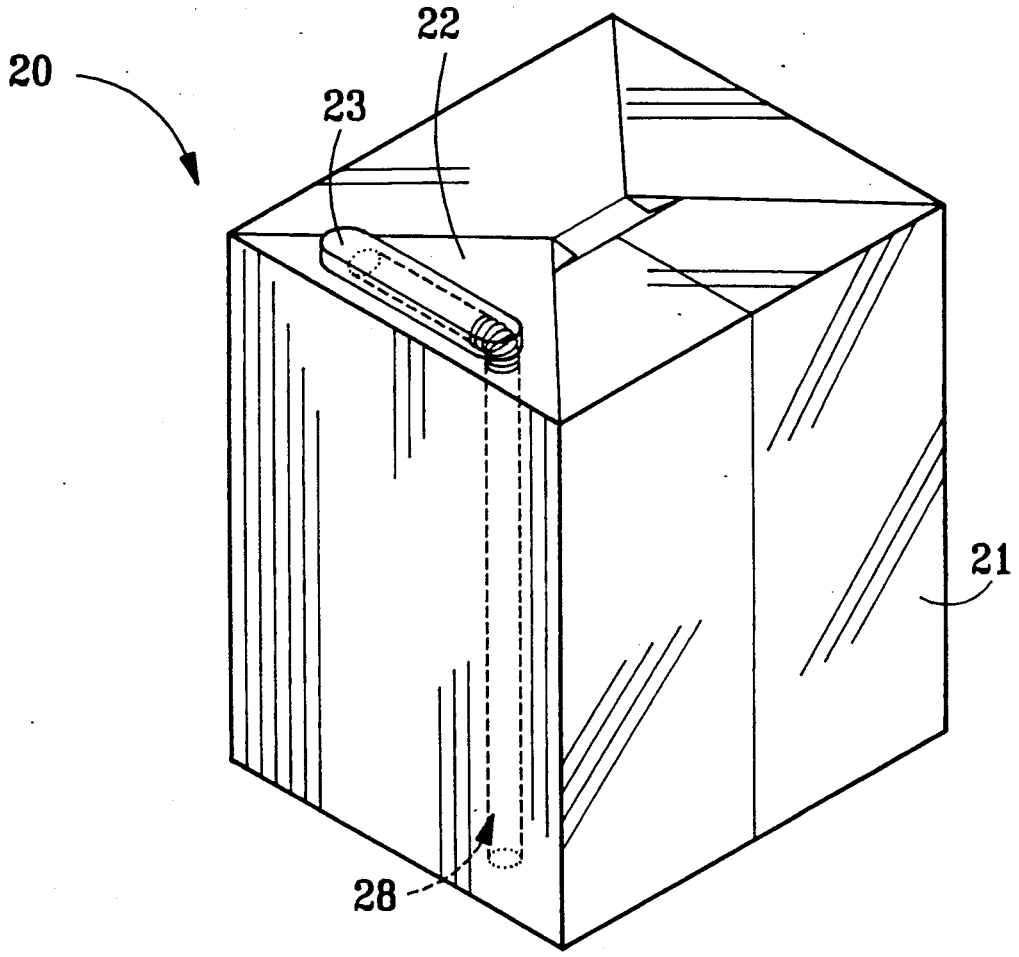
FIG. 2 is a perspective view of another embodiment of the beverage container with concealed straw according to the present invention.
Figure 2A:
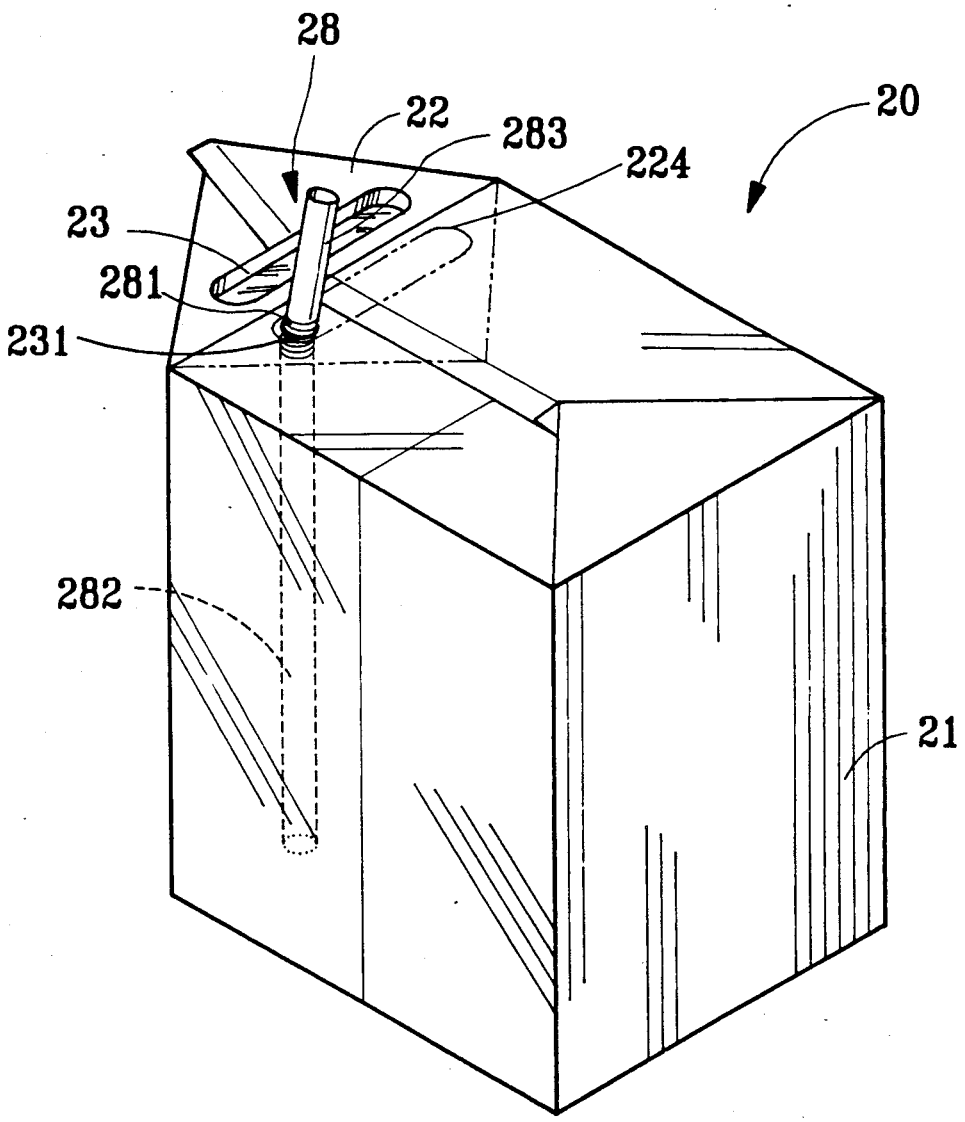
FIG. 2A illustrates the use of the second embodiment of the beverage container with concealed straw according to the present invention.

Please refer to FIGS. 2 and 2A for another embodiment of the present invention. In the second embodiment, the beverage container with concealed straw (20) has a concealed straw (28) fixed within a paper container (21). A groove section (23) of adequate length is formed on the inner side of a top tuck flap (22) of the container (21), and an opening (231) in a matching position with the groove section (23) is formed on the container (21) so that the lower portion of the concealed straw (28) can be inserted through the opening (23)

while the upper portion of the concealed straw (28) remains outside the container (21). The concealed straw (28) has a pleated section (281) so that its upper portion (283) can be bent to a certain direction. The tuck flap (22) is then folded onto an area (224) defined by a dashed line on the container (21) so that the upper portion (283) of the concealed straw (28) is kept within the groove section (23).

Figure 3:
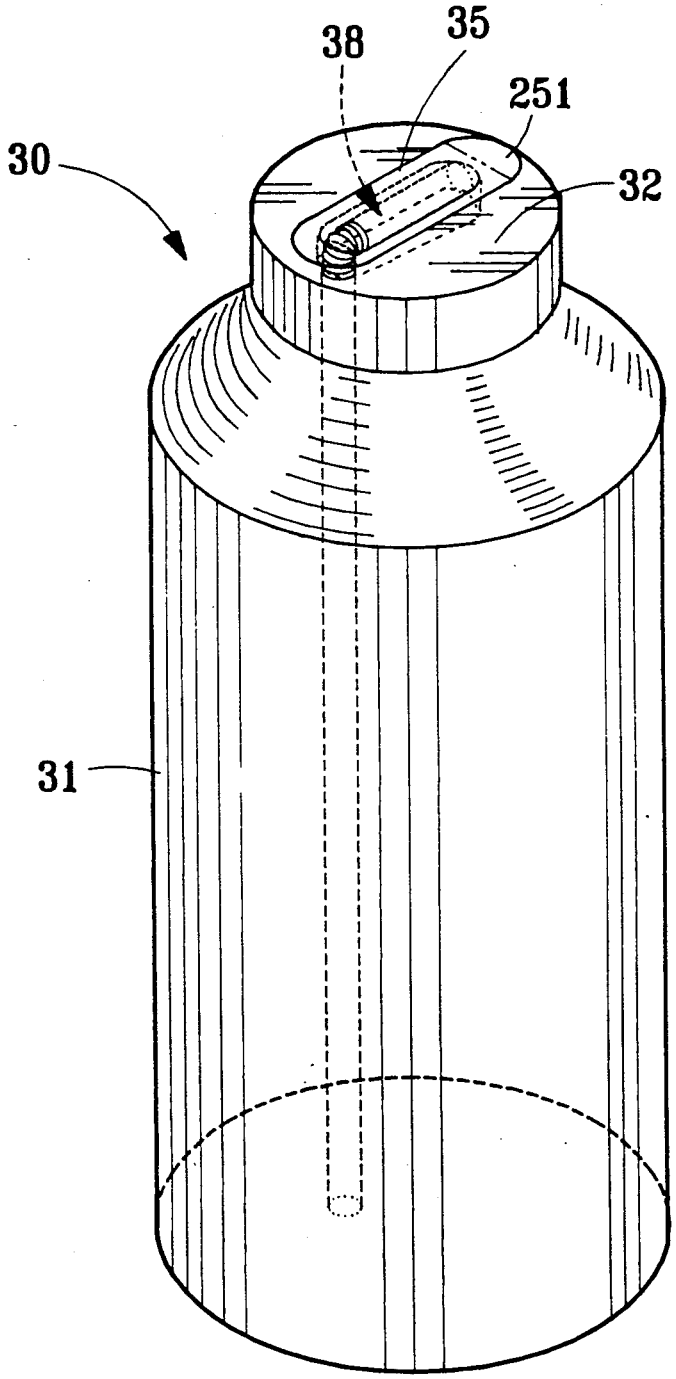
FIG. 3 is a perspective view of the third embodiment of the beverage container with concealed straw according to the present invention.
Figure 3A:
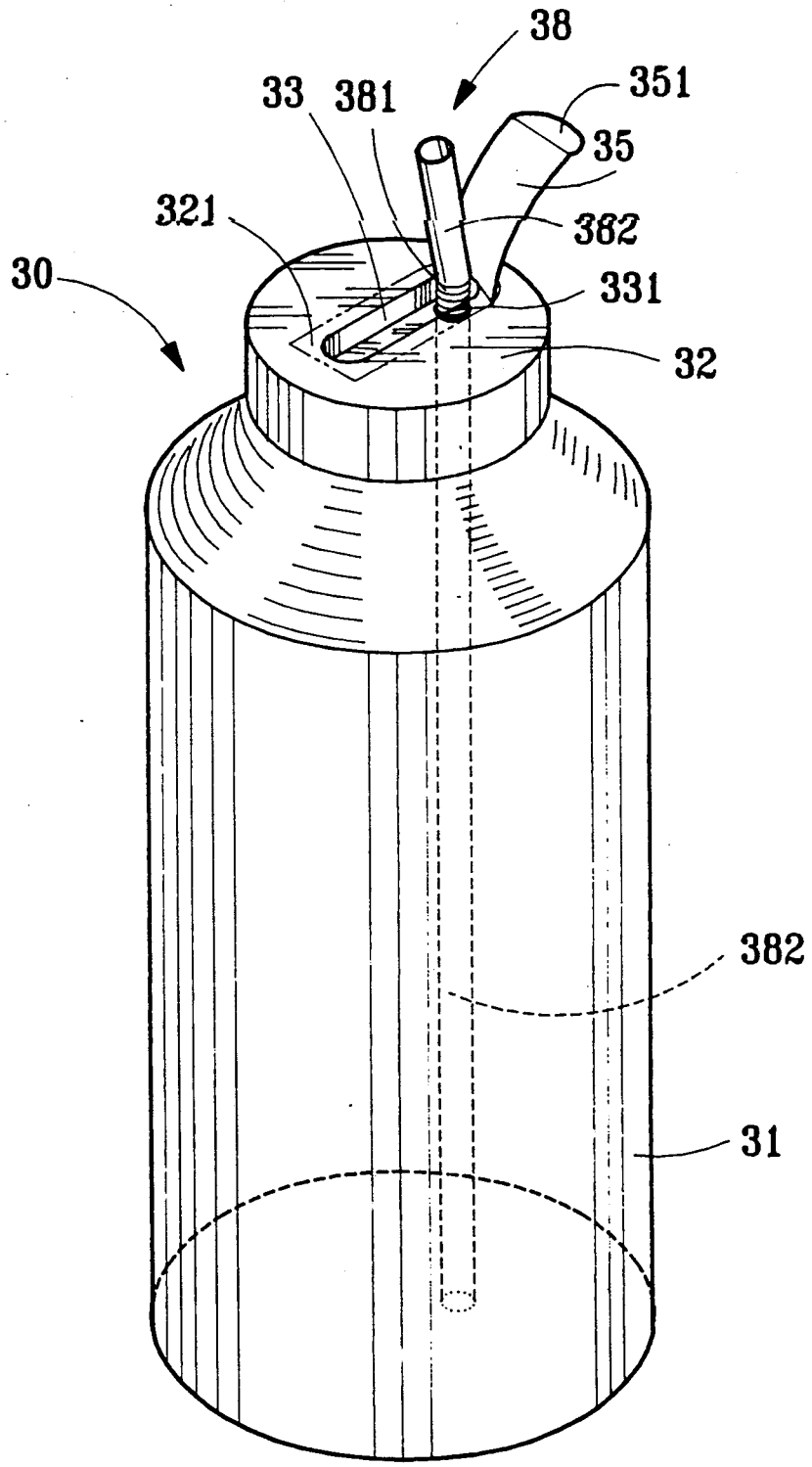
FIG. 3A illustrates the use of the third embodiment of the beverage container with concealed straw according to the present invention.

Please refer to FIGS. 3 and 3A for the third embodiment of the present invention. The beverage container with concealed straw (30) has a concealed straw (38) fixed within a plastic container (31). There is a slot (33) of adequate length on an upper cover (32) located on the top of the container (31), and there is an opening (331) in the slot (33) so that the lower portion (382) of the concealed straw (38) can be inserted through the opening (331). The concealed straw (38) has a pleated section (381) so that its upper portion can be bent to a certain direction. A sealing tape (32) is then adhered to the area (321) surrounded by a dashed line on the upper cover (32) so that the upper portion (382) of the concealed straw (38) is kept within the slot (33). Thus, by lifting the sealing tape (25) from a lifting tab (351), and pulling the concealed straw (38) up to an appropriate degree, the beverage in the container (31) can be sucked.

Figure 4:
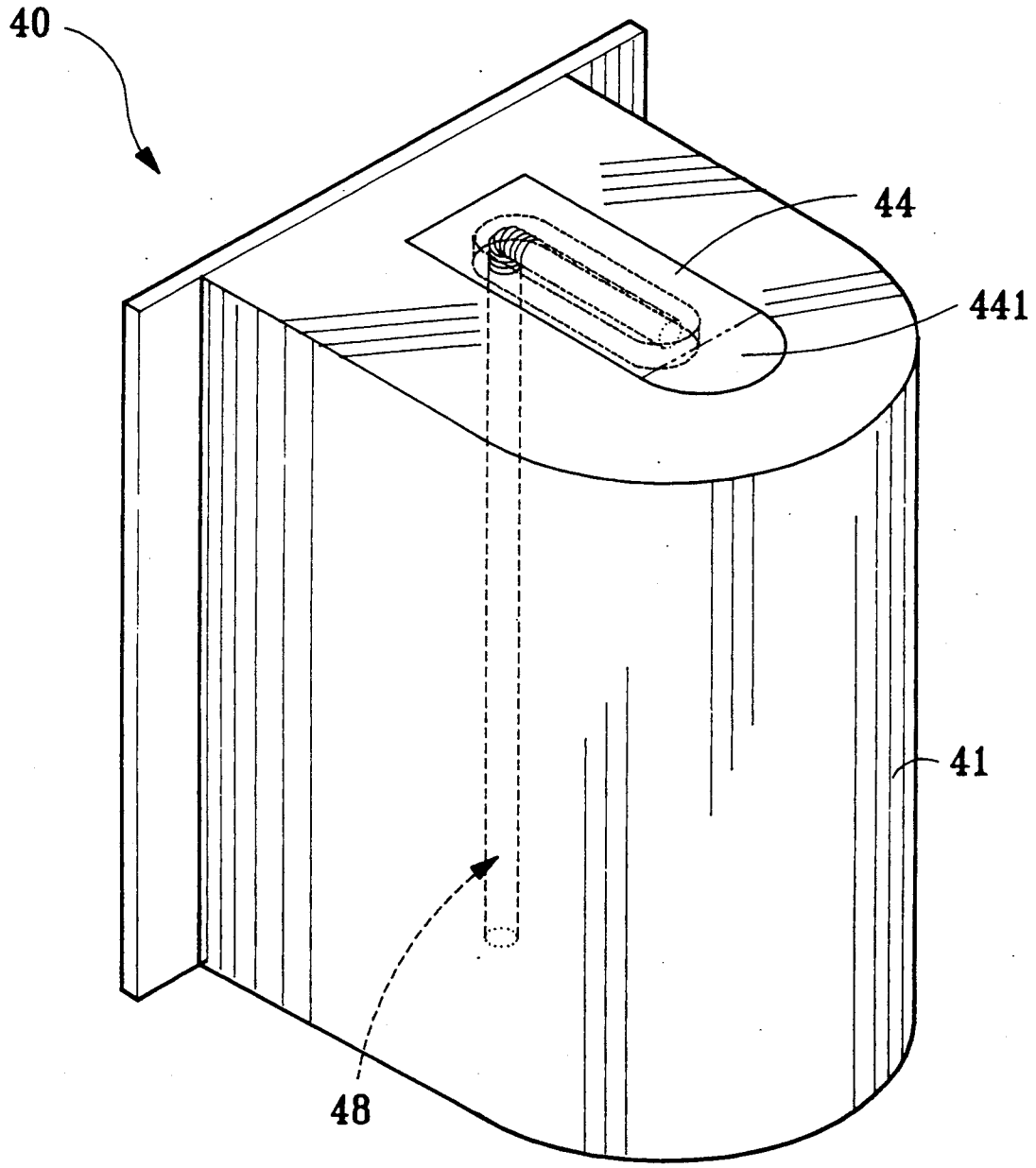
FIG. 4 is a perspective view of the fourth embodiment of the beverage container with concealed straw according to the present invention.
Figure 4A:
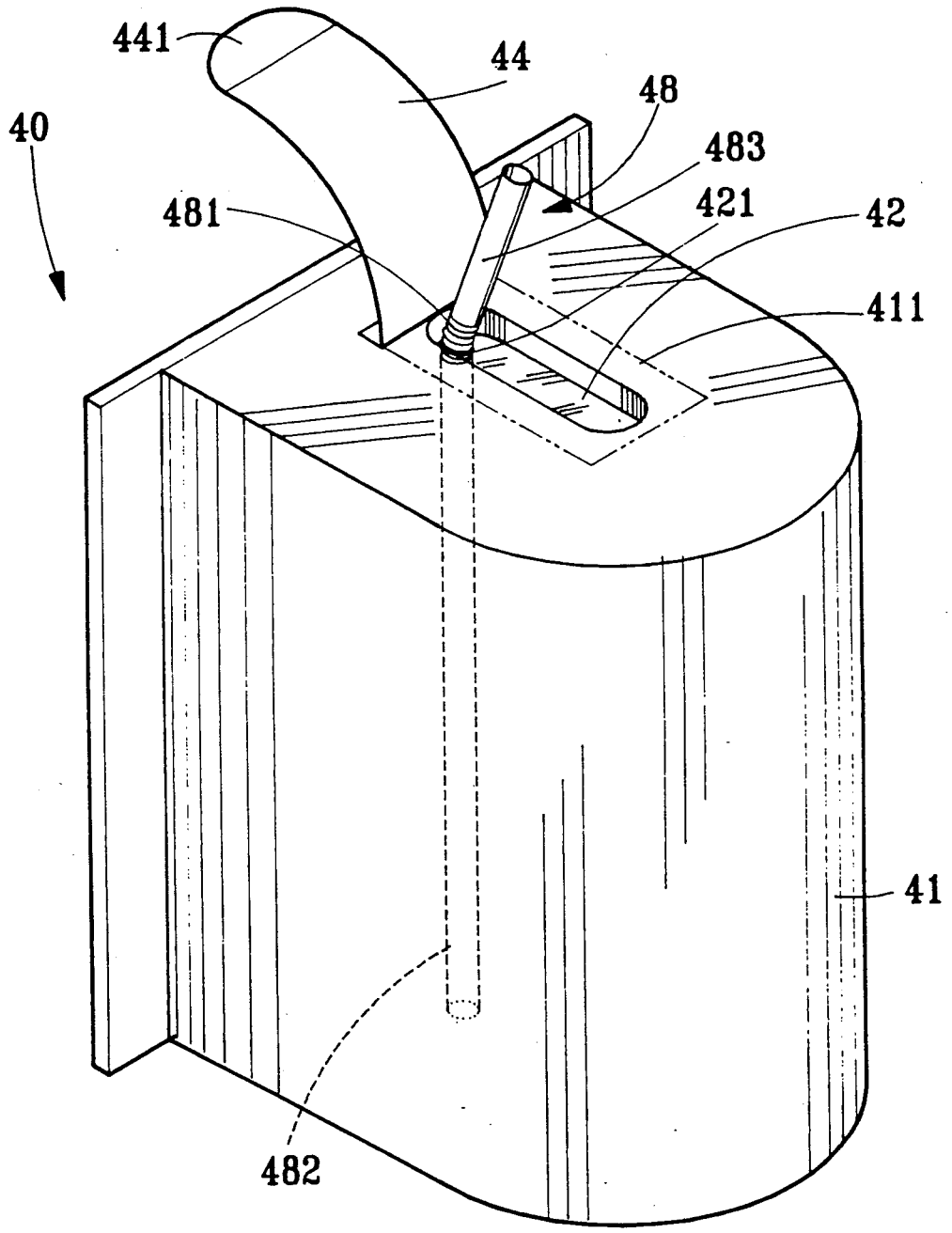
FIG. 4A illustrates the use of the fourth embodiment of the beverage container with concealed straw according to the present invention.

Please refer to FIGS. 4 and 4A for the fourth embodiment of the present invention. The beverage container with concealed straw (40) has a concealed straw (48) fixed in a container (41) made of foamed plastic material. There is a slot (41) of adequate length on the container (41), and there is an opening (4211) in the slot (42) so that the lower portion (482) of the concealed straw (48) can be inserted through the opening (421). The concealed straw (38) has a pleated section (481) so that its upper portion (483) can be bent to a certain direction. A sealing tape (44) is then adhered to the area (411) surrounded by a dashed line on the container (41) so that the upper portion (483) of the concealed straw (48) is kept within the slot (42). Thus, by lifting the sealing tape (44) from a lifting tab (441), and pulling the concealed straw (48) up to an appropriate degree, the beverage in the container (41) can be sucked.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A beverage container with concealed straw comprising:

(a) a container to hold a liquid, said container having a plurality of top tuck flaps, which include at least first and second top tuck flaps, for closing said container in a sealed manner by folding said top tuck flaps and applying a sealing material therebetween;

(b) said first top tuck flap having a flat surface and a round hold therethrough;

(c) a concealed straw having a diameter similar to that of said round hole in said first top tuck flap, said straw having a pleated section which penetrates through said round hole, a lower section below said pleated section, and an upper section above said pleated section, whereby said pleaded section allows said upper section to be folded against said flat surface of said first top tuck flap; and (d) said second top tuck flap having a recessed groove for receiving said upper section of said concealed straw when said second top tuck flap is folded to close said container, and said upper section of said straw will be unconcealed when said second top tuck flap is unfolded.

* * * * *